US009360785B2

(12) United States Patent
Motani et al.

(10) Patent No.: US 9,360,785 B2
(45) Date of Patent: Jun. 7, 2016

(54) TONER FOR ELECTROSTATIC IMAGE DEVELOPMENT, TWO-COMPONENT DEVELOPER, AND IMAGE FORMATION PROCESS

(71) Applicant: Konica Minolta, Inc., Tokyo (JP)

(72) Inventors: Hitomi Motani, Tokyo (JP); Ito Koga, Tokyo (JP); Tomomi Oshiba, Tokyo (JP); Kishio Tamura, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/283,875

(22) Filed: May 21, 2014

(65) Prior Publication Data

US 2014/0349230 A1 Nov. 27, 2014

(30) Foreign Application Priority Data

May 23, 2013 (JP) ..... 2013-108694

(51) Int. Cl.

| | |
|---|---|
| ***G03G 9/093*** | (2006.01) |
| ***G03G 8/00*** | (2006.01) |
| *G03G 9/08* | (2006.01) |
| *G03G 9/087* | (2006.01) |

(52) U.S. Cl.

CPC ..... *G03G 9/09328* (2013.01); *G03G 8/00* (2013.01); *G03G 9/09364* (2013.01); *G03G 9/09392* (2013.01); *G03G 9/0819* (2013.01); *G03G 9/08711* (2013.01); *G03G 9/08726* (2013.01); *G03G 9/08755* (2013.01); *G03G 9/08795* (2013.01); *G03G 9/08797* (2013.01)

(58) Field of Classification Search

CPC ..... G03G 9/09321; G03G 9/09328; G03G 9/08711; G03G 9/08728; G03G 9/08755; G03G 8/00

USPC ..... 430/109.3, 109.4, 110.2, 126.1

See application file for complete search history.

(56) References Cited

U.S. PATENT DOCUMENTS

| | | | | |
|---|---|---|---|---|
| 4,865,943 | A * | 9/1989 | Wright | 430/138 |
| 4,882,259 | A * | 11/1989 | O'Connor et al. | 430/138 |
| 5,948,584 | A * | 9/1999 | Hashimoto et al. | 430/109.3 |
| 5,976,752 | A * | 11/1999 | Matsunaga et al. | 430/108.23 |
| 7,858,279 | B2 * | 12/2010 | Halfyard et al. | 430/97 |
| 2008/0014513 | A1 * | 1/2008 | Sisler et al. | 430/11 |
| 2009/0081421 | A1 * | 3/2009 | Kakino | G03G 8/00 428/195.1 |
| 2009/0324269 | A1 * | 12/2009 | Iraqi | 399/57 |
| 2012/0264040 | A1 * | 10/2012 | Wu | G03G 8/00 428/195.1 |
| 2013/0004890 | A1 * | 1/2013 | Obara | G03G 9/09328 430/109.3 |
| 2014/0011949 | A1 * | 1/2014 | Asami | G03G 8/00 524/558 |

FOREIGN PATENT DOCUMENTS

| | | | |
|---|---|---|---|
| JP | 2011-191536 | A | 9/2011 |
| JP | 2012-078485 | A | 4/2012 |

OTHER PUBLICATIONS

"Radcure Coating Resins" Product Guide, Allnex Group, 36 pages. (2014).*

* cited by examiner

*Primary Examiner* — Christopher D Rodee

(74) *Attorney, Agent, or Firm* — Lucas & Mercanti, LLP

(57) ABSTRACT

Disclosed are a toner for electrostatic image development and an image formation process using the same which can achieve high varnish application property and high adhesion of a heat-fixed image to a varnish layer even when the varnish layer is formed on the fixed image formed by an image formation process of an electrophotographic system.

The toner for electrostatic image development includes toner particles containing at least a binder resin, a colorant and a parting agent, and the binder resin contains a polyfunctional acrylate-modified polyester resin obtained by modification with a polyfunctional acrylate compound. In the toner for electrostatic image development, it is preferable that the toner particles have a core-shell structure, in which the surface of a core particle is coated with a shell layer, and the polyfunctional acrylate-modified polyester resin is contained in the shell layer.

15 Claims, No Drawings

TONER FOR ELECTROSTATIC IMAGE DEVELOPMENT, TWO-COMPONENT DEVELOPER, AND IMAGE FORMATION PROCESS

CROSS REFERENCE TO RELATED APPLICATION

This application claims the priority of Japanese Patent Application No. 2013-108694 filed on May 23, 2013, which is incorporated by reference herein.

TECHNICAL FIELD

The present invention relates to a toner for electrostatic image development which is used in image formation of an electrophotographic system and in particular, to a toner for electrostatic image development which is used to formation a fixed image having excellent varnish application property and excellent adhesion to a varnish layer, and also to a two-component developer and an image formation process using the same.

BACKGROUND ART

In recent years, an image formation process of an electrophotographic system has been adopted in a production printing (PP) market. In the image formation process, a plate for printing is not required, so that the necessary number of printed sheets can be formed on demand. Further, in order to improve image quality and durability, a varnish, is applied to an image to form a varnish coating film (hereinafter may also be referred to as "varnish layer") in the PP market. Requirements for application of a varnish to a toner image formed by the image formation process of an electrophotographic system or an image obtained by heat-fixing the toner image (hereinafter may also be collectively referred to as "fixed image") have also increased.

However, the fixed image obtained by the image formation process of an electrophotographic system has problems such as varnish repellent due to its low varnish application property. Furthermore, even when the varnish can be applied, the fixed image has problems such as deterioration of adhesion to a varnish layer.

Such problems may be caused by a wax bleed-out to the surface of the fixed image due to heat-fixing or exposed on the surface of the toner image due to the configuration of toner particles. In order to solve the problems, use of a polar wax as a parting agent to improve the wetting property of a varnish and the varnish application property has been proposed (see Patent Literatures 1 and 2).

However, the varnish application property may not be sufficiently imparted to a fixed image obtained by the use of the polar wax.

Furthermore, the kind of used wax is restricted, so that the degree of freedom of selection of wax is low.

CITATION LIST

Patent Literature

Patent Literature 1; Japanese Patent application laid-Open No. 2012-78485

Patent Literature 2; Japanese Patent Application Laid-Open No. 2011-191536

SUMMARY OF INVENTION

Technical Problem

The present invention has been made on the basis of the foregoing circumstances and has as its object the provision of a toner for electrostatic image development which can achieve high varnish application property and high adhesion of a varnish layer to a fixed image even when the varnish layer is formed on the fixed image formed by an image formation process of an electrophotographic system. The invention also has as its object the provision of a two-component developer and an image formation process using these.

Solution to Problem

A toner for electrostatic image development of the present invention includes toner particles containing at least a binder resin, a colorant and a parting agent, and the binder resin contains a polyfunctional acrylate-modified polyester resin obtained by modification with a poly functional acrylate compound.

In the toner for electrostatic image development of the present invention, it is preferable that the toner particles have a core-shell structure, in which the surface of a core particle is coated with a shell layer, and the polyfunctional acrylate-modified polyester resin is contained in the shell layer.

In the toner for electrostatic image development of the present invention, it is preferable that the polyfunctional acrylate-modified polyester resin has a moiety derived from the polyfunctional acrylate compound on the terminal thereof.

In the toner for electrostatic image development of the present invention, it is preferable that the polyfunctional acrylate compound is at least one kind selected from the group consisting of 2-hydroxy-3-acryloyloxypropyl methacrylate, pentaerythritol triacrylate, glycerin dimethacrylate and 3-acryloyloxy-2,2-bis (acryloyloxy (methyl)) propionic acid.

In the toner for electrostatic image development of the present invention, it is preferable that the polyfunctional acrylate-modified polyester resin has a glass transition point of 50 to 65° C.

In the toner for electrostatic image development of the present invention, it is preferable that the polyfunctional acrylate-modified polyester resin has a weight average molecular weight (Mw) of 10,000 to 40,000.

In the toner for electrostatic image development of the present invention, it is preferable that the content of the polyfunctional acrylate-modified polyester resin in the whole binder resin is 5 to 100% by mass.

In the toner for electrostatic image development of the present invention, it is preferable that the core particles are formed from a styrene-acrylic copolymer resin.

In the toner for electrostatic image development of the present invention, it is preferable that the core particles are formed from a styrene-acrylic copolymer resin, and the styrene-acrylic copolymer resin has a weight average molecular weight (Mw) of a THF-soluble portion of 25,000 to 50,000 determined by gel permeation chromatography (GPC).

In the toner for electrostatic image development of the present invention, it is preferable that the resin constituting the core particles has a glass transition point of 30 to 45° C.

In the toner for electrostatic image development of the present invention, it is preferable that the content of the parting agent in the toner particles is 3 to 15% by mass.

In the toner for electrostatic image development of the present invention, it is preferable that the average particle diameter of the toner particles is 3 to 10 μm in terms of a volume-based median diameter.

In the toner for electrostatic image development of the present invention, it is preferable that the toner particles are produced by an emulsion polymerization process.

In the toner for electrostatic image development of the present invention, it is preferable that the toner particles are produced by in an aqueous medium, associating, aggregating and fusing fine particles containing a styrene-acrylic copolymer resin and fine colorant particles to produce core particles; then adding fine particles of the polyfunctional acrylate-modified polyester resin to form a shell layer into a dispersion liquid of the core particles; and aggregating and fusing the fine particles of the polyfunctional acrylate-modified polyester resin on the surface of the core particles, thereby forming a shell layer coating the surface of the core particles.

The two-component developer of the present invention comprises the above-described toner for electrostatic image development and a carrier.

An image formation process of the present invention comprises; a developing step of developing an electrostatic latent image formed on an image carrier with the above-described toner for electrostatic image development; a transferring step of transferring a developed toner image to an image support; and a step of applying a photocurable varnish to the toner image transferred to the image support or a fixed image obtained by heat-fixing the toner image and exposing the varnish to light to form a varnish layer.

In the image formation process of the present invention, it is preferable that the photocurable varnish contains a radically polymerizable compound. Further preferable is that the photocurable varnish contains a polyfunctional radically polymerizable oligomer, a polyfunctional radically polymerizable monomer, a photopolymerization initiator and a surfactant.

Advantageous Effects of Invention

According to the toner for electrostatic image development of the present invention, high varnish application property and high adhesion of a varnish layer to a fixed image can be achieved even when the varnish layer is formed on the fixed Image. This is because the toner particles contain the polyfunctional acrylate-modified polyester resin obtained by modification with a polyfunctional acrylate compound.

DESCRIPTION OF EMBODIMENTS

The present invention will hereinafter be described specifically.

The toner for electrostatic image development (hereinafter may also be referred to as "toner" simply) of the present invention includes toner particles containing at least a binder resin containing a polyfunctional acrylate-modified polyester resin obtained by modification with a polyfunctional acrylate compound, a colorant and a parting agent.

Binder Resin:

The binder resin constituting the toner particles according to the present invention contains a polyfunctional acrylate-modified polyester resin, in addition to which the binder resin may contain another resin in combination.

Polyfunctional Acrylate-modified Polyester Resin:

The polyfunctional acrylate-modified polyester resin is obtained by modifying an unmodified polyester resin with a polyfunctional acrylate compound. Specifically, the polyfunctional acrylate-modified polyester resin has an unmodified polyester resin as a main chain and a moiety derived from a polyfunctional acrylate compound, which is bonded to the main chain and/or the terminal of the main chain. In the polyfunctional acrylate-modified polyester resin, the moiety derived from a polyfunctional acrylate compound may be located at any position of the polyfunctional acrylate-modified polyester resin. In particular, it is preferable that the moiety derived from a polyfunctional acrylate compound is located at the terminal of the polyfunctional acrylate-modified polyester resin.

Synthesis Process of Polyfunctional Acrylate-modified Polyester Resin:

The polyfunctional acrylate-modified polyester resin can be synthesized as the following example. An unmodified polyester resin is reacted with a specific polyfunctional acrylate compound having at least one group selected from the group consisting of a hydroxyl group and a carboxyl group, to cause dehydration and condensation of at least one hydroxyl group and/or carboxyl group in the specific polyfunctional acrylate compound with a carboxyl group and/or a hydroxyl group in the terminal or the main chain of the unmodified polyester resin, forming an ester bond.

Specific Polyfunctional Acrylate Compound:

The specific polyfunctional acrylate compound has two or more (meth)acryloyl groups and at least one of a hydroxyl group and a carboxyl group.

In the present invention, a (meth)acryloyl group collectively refers to an acryloyl group ($H_2C{=}CH{-}C({=}O){-}$) and a methacryloyl group ($H_2C{=}C(CH_3){-}C({=}O){-}$).

As examples of a specific polyfunctional acrylate compound having a hydroxyl group, may be mentioned 2-hydroxy-3-acryloyloxypropyl methacrylate, pentaerythritol triacrylate and glycerin dimethacrylate. As examples of a specific polyfunctional acrylate compound having a carboxyl group, may be mentioned 3-acryloyloxy-2,2-bis(acryloyloxy (methyl))propionic acid.

Unmodified Polyester Resin:

An unmodified polyester resin used for synthesis of the polyfunctional acrylate-modified polyester resin can be synthesized by a polycondensation reaction of a polyvalent carboxylic acid component with a polyhydric alcohol component as raw materials in the presence of an appropriate catalyst.

As the polyvalent carboxylic acid component, a polyvalent carboxylic acid monomer or an alkyl ester, an acid anhydride or an acid chloride of the polyvalent carboxylic acid monomer may be used. As the polyhydric alcohol component, a polyhydric alcohol monomer, an ester compound of the polyhydric alcohol monomer or hydroxycarboxylic acid may be used.

As examples of the polyvalent carboxylic acid monomer, may be mentioned divalent carboxylic acids such, as oxalic acid, succinic acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, tumeric acid, citraconic acid, diglycolic acid, cyclohexane-3,5-diene-1,2-dicarboxylic acid, malic acid, citric acid, hexahydro terephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenyl acetic acid, p-phenylene diacetic acid, m-phenylene diglycolic acid, p-phenylene diglycolic acid, o-phenylene diglycolic acid, diphenyl acetic acid, diphenyl-p,p'-dicarboxylic acid, naphthalene-1,4-dicarboxylic acid, naphthalene-1,5-dicarboxylic acid, naphthalene--2,6-dicarboxylic acid, anthracene dicarboxylic acid and dodecenyl succinic acid; and trivalent or more polyvalent carboxylic acids such as trimellitic acid, pyromellitic acid, naphthalene tricarboxylic acid, naphthalene tetracarboxylic acid, pyrene tricarboxylic acid and pyrene tetracarboxylic acid.

As the polyhydric alcohol monomer, may be mentioned dihydric alcohols such as ethylene glycol, propylene glycol, butanediol, diethylene glycol, hexanediol, cyclohexanediol, octanediol, decanediol, dodecanediol, an ethylene oxide adduct of bisphenol A and a propylene oxide adduct of bisphenol A; and trivalent or more polyvalent polyols such as glycerol, pentaerythritol, hexamethylolmelamine, hexaethylolmelamine, tetramethylol benzoguanamine and tetraethylol benzoguanamine.

A ratio of the polyvalent carboxylic acid component to the polyhydric alcohol component is preferably 1.5/1 to 1/1.5, more preferably 1.2/1 to 1/1.2 in terms of an equivalent ratio [OH]/[COOH] of the hydroxyl group [OH] of the polyhydric alcohol component to the carboxyl group [COOH] of the polyvalent carboxylic acid component.

Various publicly known, catalysts may be used as the catalyst used for the synthesis of the unmodified polyester resin.

The unmodified polyester resin used for synthesis of the polyfunctional acrylate-modified polyester resin may partially have a branched structure or a cross-linked structure depending on the valence of the carboxyl group of the used polyvalent carboxylic acid component and/or the valence of the hydroxyl group of the used polyhydric alcohol component.

The glass transition point of the unmodified polyester resin falls within a range of preferably 40 to 70° C. more preferably 50 to 65° C. When the glass transition point of the unmodified polyester resin is not lower than 40° C., an appropriate cohesive force of the unmodified polyester resin can be achieved in a high-temperature region to suppress the occurrence of hot offset upon heat-fixing. Further, when the glass transition point of the unmodified polyester resin is not higher than 70° C., the toner can be sufficiently melted upon heat-fixing to ensure a sufficient lowest fixing temperature.

The glass transition point is measured using "Diamond DSC" (manufactured by PerkinElmer Co., Ltd.).

The procedure of the measurement will next be described. First, 3.0 mg of a measurement sample is sealed in an aluminum pan, and the pan was placed in a holder. An empty aluminum pan is used as a reference. The temperature is controlled during a Heat-Cool-Heat cycle under measurement conditions of a measurement temperature of 0° C. to 200° C., a temperature increase rate of 10° C./min and a temperature decrease rate of 10° C./min. The analysis is performed based on data in the second Heat. As the glass transition point, the intersection of the extension of a base line before the rising edge of the first endothermic peak and a tangent line representing the maximum inclination between the rising edge of the first peak and the top of the peak is used.

The weight average molecular weight (Mw) of the unmodified polyester resin fails within a range of preferably 1,500 to 60,000, more preferably 3,000 to 40,000, further preferably 10,000 to 40,000.

When the weight average molecular weight is not lower than 1,500, a cohesive force suitable for the whole binder resin can be obtained to suppress the occurrence of hot offset upon fixing. When the weight average molecular weight is not more than 60, 000, the toner can be sufficiently melted. As a result, the sufficient lowest fixing temperature can be ensured, ana the occurrence of hot offset upon fixing can be suppressed.

The molecular weight is measured by gel permeation chromatography (GPC). Specifically, a device "HLC-8820" (manufactured by TOSOH CORPORATION) and three series of column "TSKguard column+TSKgel Super HZM-M" (manufactured by TOSOH CORPORATION) are used for the measurement. Tetrahydrofuran (THF) as a carrier solvent is passed through the column at a flow rate of 0.2 mL/min with the column temperature kept at 40° C. A measurement sample is dissolved in tetrahydrofuran at a concentration of 1 mg/ml using an ultrasonic dispenser under dissolution conditions of room temperature and 5 minutes. The dissolved solution is then passed through a membrane filter with a pore size of 0.2 μm to obtain a sample solution. 10 μL of the sample solution is injected together with the carrier solvent into the device. The measurement sample is detected using a refractive index detector (RI detector). The molecular weight distribution of the measurement sample is calculated using a calibration curve determined using monodispersed polystyrene standard particles. At least 10 standard polystyrene samples, for example, standard polystyrene samples having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$ (available from Pressure Chemical Company), are used for the preparation of a calibration curve, and the calibration curve is prepared. As a detector, the refractive index detector is used.

According to a toner containing the polyfunctional acrylate-modified polyester resin, even when a varnish layer of a photocurable varnish is formed on a fixed image, high photocurable varnish application property can be achieved, and high adhesion of the varnish layer to the fixed image can be achieved.

The reason for this is considered to be as follows. The toner particles contain the polyfunctional acrylate-modified polyester resin having a moiety derived from a polyfunctional acrylate compound having two or more (meth)acryloyl groups. The moiety derived from the polyfunctional acrylate compound of the polyfunctional acrylate-modified polyester resin is exposed on the surface of the fixed image. In this case, the polarity of the (meth)acryloyl groups in the moiety increases the affinity to the photocurable varnish, so that varnish repellent is suppressed. Further, an unsaturated bond in the (meth)acryloyl groups is reacted with a compound constituting the photocurable varnish during curing the photocurable varnish, to produce a chemical bond. This may improve the adhesion of the varnish layer to the fixed image.

In particular, when the moiety derived from the polyfunctional acrylate compound is located at the terminal of the polyfunctional acrylate-modified polyester resin, the moiety derived from the polyfunctional acrylate compound can be sufficiently oriented on the surface of the fixed image after heat-fixing. Therefore, high photocurable varnish application property and high adhesion of the varnish layer to the fixed image can be surely achieved.

The presence of the polyfunctional acrylate-modified polyester resin in the binder resin constituting the toner particles can be confirmed by the appearance of absorption peak of C=C bond derived from the polyfunctional acrylate compound in measurement in accordance with Fourier transform infrared-Attenuated total reflectance (FTIR-ATR) spectroscopy.

As another resin which may be contained in the binder resin, any resin may be used without limitation. As specific examples thereof, may be mentioned a vinyl-based polymer such as a styrene resin, an acrylic resin and a styrene-acrylic copolymer resin, an olefin resin, a polyester resin, a silicone resin, an amide resin and an epoxy resin. In particular, a styrene-acrylic copolymer resin is suitable for improvement of transparency and color reproducibility of overlapped image since it has high transparency and sharp melting property, in which the melting property is high at low viscosity. These resins may be used either singly or in any combination thereof.

For example, the total content of the binder resin in the toner particles is 50 to 98% by mass.

For example, the content of the polyfunctional acrylate-modified polyester resin in the whole binder resin is 5 to 100% by mass.

When the content of the polyfunctional acrylate-modified polyester resin is not lower than 5% by mass, the moiety derived from the polyfunctional acrylate compound can be surely located on the surface of the fixed image after heat-fixing. Therefore, high photocurable varnish application property and high adhesion of the varnish layer to the fixed image can be reliably achieved.

Toner Particles having Core-shell Structures:

The toner particles according to the present invention have, for example, a core-shell structure, in which the surface of a core particle is coated with a shell layer.

In toner particles having a core-shell structure, the polyfunctional acrylate-modified polyester resin may be contained in a core particle and/or a shell layer, preferably in at least a shell layer.

In particular, when a styrene-acrylic copolymer resin is used as a resin constituting core particles (hereinafter may also be referred to as "core resin") it is preferable that the polyfunctional acrylate-modified polyester resin is contained in a shell layer. This is because the styrene-acrylic copolymer resin has lower photocurable varnish, application property as compared with a polyester resin.

The shape of the toner particles having a core-shell structure is not limited to a shape in which, a core particle is completely coated with a shell layer, and the toner particles may have a shape in which the core particle is partially coated with the shell layer. Furthermore, the toner particles may have a shape in which a domain or the like may be formed in the core particles from part of a resin constituting the shell layer. The shell layer may have a multilayer structure of two or more layers made from resins having different compositions. When the shell layer has a multilayer structure, it is preferable that the polyfunctional acrylate-modified polyester resin is contained in the shell layer.

When the core resin is a styrene-acrylic copolymer resin, the weight average molecular weight (Mw) of a THF-soluble portion determined by GPC as the molecular weight of the resin is preferably 10,000 to 50,000, more preferably 25,000 to 50,000.

When the weight average molecular weight (Mw) of the core resin fails within the above-described range, the low-temperature fixing property and the separability after fixing can be reliably achieved.

The molecular weight of the core resin is measured in the same manner as described above except for using the core resin as the measurement sample.

When the core resin is a styrene-acrylic copolymer resin, the glass transition point (Tg) thereof is preferably 30 to 50° C., more preferably 30 to 45° C.

When the glass transition point of the core resin falls within the above-described range, both, the low-temperature fixing property and the heat-resistant storage stability can be achieved.

The glass transition point is measured in the same manner as described above except for using the core resin as the measurement sample.

Component Constituting Toner Particles:

The toner particles according to the present invention may contain at least the binder resin, the colorant and the parting agent, and if necessary, an internal additive such as a charge control agent.

Colorant:

As the colorant, carbon, black, a magnetic material, a dye or a pigment may be optionally used.

As the carbon black, channel black, furnace black, acetylene black, thermal black or lamp black may be used.

As the magnetic material, ferromagnetic metal such as iron, nickel and cobalt, an alloy containing the metals or an oxide of ferromagnetic metal such as ferrite and magnetite may be used.

As the pigment, C.I. Pigment Red: 2, 3, 5, 7, 15, 16, 48:1, 48:3, 53:1, 57:1, 81:4, 122, 123, 139, 144, 149, 166, 177, 178, 208, 209 or 222, C.I. Pigment Orange: 31 or 43, C.I. Pigment Yellow: 3, 3, 14, 17, 35, 36, 65, 74, 83, 93, 94, 98, 110, 111, 138, 139, 153, 155, 180, 181 or 185, C.I. Pigment Green 7, C.I. Pigment Blue: 15:3, 15:4 or 60, a phthalocyanine pigment in which a central metal is zinc, titanium or magnesium, or a mixture thereof may be used. As the dye, C.I. Solvent Red: 1, 3, 14, 17, 18, 22, 23, 49, 51, 52, 58, 63, 87, 111, 122, 127, 128, 131, 145, 146, 149, 150, 151, 152, 153, 154, 155, 156, 157, 158, 176 or 179, a pyrazolotriazole azo dye, a pyrazolotriazole azomethine dye, a pyrazolone azo dye, a pyrazolone azomethine dye, C.I. Solvent Yellow: 19, 44, 77, 79, 81, 82, 93, 98, 103, 104, 112 or 162, C.I. Solvent Blue: 25, 36, 60, 70, 93 or 95 or a mixture thereof may be used.

The content of the colorant in the toner particles is preferably 1 to 30% by mass, more preferably 2 to 20% by mass. When the content of the colorant in the toner particles falls within the above-described range, a fixed image formed by the toner has a sufficient density. In addition, excellent charge property can be ensured.

Parting Agent:

No particular limitation is imposed on the parting agent, and as examples thereof, may be mentioned a polyolefin wax such as a polyethylene wax and a polypropylene wax, a long-chain hydrocarbon-based wax such as a paraffin wax and Sasol wax, a diaralkyl ketone-based wax such as distearyl ketone, an ester-based wax such as a carnauba wax, a montan wax, trimethylolpropane tribehenate, pentaerythritol tetramyristate, pentaerythritol tetrastearate, pentaerythritol tetrabehenate, pentaerythritol diacetate dibehenate, glycerol tribehenate, 1,18-octadecanediol distearate, tristearyl trimellitate and distearyl maleate and an amide-based wax such as ethylenediamine dibehenyl amide and tristearylamide trimellitate.

The content of the parting agent in the toner particles is preferably 0.5 to 25% by mass, more preferably 3 to 15% by mass.

When the content of the parting agent falls within the above-described range, both sufficient releasability and high heat-resistant storage stability can be reliably achieved. Further, the transparency and the color reproducibility are excellent. When the content of the parting agent is too small, sufficient releasability may not be achieved. In contrast, when the content of the parting agent is too large, the heat-resistant storage stability may be degraded, and a fixed image to be formed may have low transparency ana low color reproducibility.

Charge Control Agent:

The toner particles constituting the toner of the present invention may contain a charge control agent. The charge control agent is not particularly limited as long as the charge control agent is a colorless material which can impart positive or negative charge by triboelectric charging. Various publicly known charge control agents exhibiting positive charge property and charge control agents exhibiting negative charge property can be used.

The content of the charge control agent in the toner particles is preferably 0.01 to 30% by mass, more preferably 0.1 to 10% by mass.

Softening Point of Toner:

The softening point of the toner of the present invention is preferably 80 to 130° C., more preferably 90 to 110° C. from the viewpoint of imparting the low-temperature fixing property to the toner.

The softening point of the toner is measured with a flow tester described below.

Specifically, 1.1 g of the toner is first placed in a Petri dish and smoothed under an environment, of 20° C. and. 50% RH and then allowed to stand for 12 hours or longer. The toner is then pressed, for 30 seconds at a force of 3,820 kg/cm$^2$ with a molding machine "SSP-10A" (manufactured by Shimadzu Corporation) to produce a columnar molded sample having a diameter of 1 cm. Subsequently, this molded sample is extruded under conditions of a load of 196 N (20 kgf), a starting temperature of 60° C., a preheating time of 300 seconds and a temperature increasing rate of 6° C./min through a hole (1 mm in diameter×1 mm) of a columnar die using a piston having a diameter of 1 cm after completion of preheating with a flow tester "CFT-500D" (manufactured by Shimadsu Corporation) under an environment of 24° C. and 50% RH. An offset method temperature $T_{offset}$ measured by setting an offset value to 5 mm in a melting temperature measuring method using temperature rising is defined as the softening point of the toner.

Particle Diameter of Toner:

For example, the particle diameter of the toner of the present invention is preferably 3 to 10 μm, more preferably 3 to 8 μm in terms of a volume-based median diameter. When the volume-based median diameter falls within the above-described range, a very minute dot image of a level of, for example, 1,200 dpi (dpi: dot number per inch (2.54 cm)) can be faithfully reproduced.

The volume-based median diameter of the toner is measured and calculated using a measuring device composed of "Multisizer 3" (manufactured by Beckman Coulter, Inc.) and a computer system (manufactured by Sectarian Coulter, Inc.) for data processing which is connected thereto. Specifically, 0.02 g of the toner is added to 20 mL of a surfactant solution (for example, a surfactant solution prepared by diluting a neutral detergent containing a surfactant component with pure water to 10 times for dispersion of the toner) and left to stand, ultrasonic dispersion is then carried out for 1 minute to prepare a dispersion liquid of the toner. This toner dispersion liquid is poured into a beaker in which "ISOTON II" (manufactured by Beckmann Coulter, Inc.) has been placed within a sample stand using a pipette until an indicator concentration of the measuring device reaches 8%. At this time, when the concentration is controlled to this range, a reproducible measured value can be obtained. In the measuring device, the counted number of particles to be measured is set to 25,000, the aperture diameter is set to 100 μm, and the frequency value within a range of 1 to 30 μm which is a measuring range divided, into 256 portions is calculated. The particle diameter of 50% from the largest integrated volume fraction, is defined as a volume-based median diameter.

Average Circularity of Toner:

In the toner of tee present invention, the arithmetic average value of circularity of the individual toner particles constituting the toner, which is represented by the following equation (T), is preferably 0.850 to 0.990 from the viewpoint of improvement of transfer efficiency.

Equation (T): circularity=(peripheral length of a circle having the same projected area as a prelected area of a particle)/(peripheral length of a projected image of the particle).

Here, the average circularity of the toner particles is a value measured using "FPIA-2100" (manufactured by SYSMEX CORPORATION).

Specifically, the toner particles are wetted with an aqueous surfactant solution, and ultrasonic dispersion is carried out for 1 minute to disperse the toner particles. Measurement is then carried out under measuring conditions of an HPF (high-magnification imaging) mode using "FPIA-2100" at a proper concentration of HPF detection number of 3,000 to 10,000. When the concentration falls within this range, a reproducible measured value can be obtained.

Production Process of Toner:

As examples of a production, process of the toner of the present invention, may be mentioned a kneading-pulverizing process, a suspension polymerization process, an emulsion polymerization process, an emulsion association process, an emulsion polymerization aggregation process, a mini-emulsion polymerization aggregation process, an encapsulation process and other publicly-known processes. In particular, an emulsion polymerization aggregation process in which resin fine particles obtained by an emulsion polymerization process are aggregated is preferably used since the toner particles having a core-shell structure can be easily formed.

By the emulsion polymerization aggregation process, the toner particles are produced as follows. A dispersion liquid of resin fine particles constituting the binder resin which is produced by the emulsion polymerization, process and a dispersion liquid of fine colorant particles, fine parting agent particles and if necessary, fine particles of another component constituting the toner particles are mixed. The fine particles are gently aggregated while the repulsive force of surface of the fine particles due to pH control and the cohesive force due to addition of a flocculant which is an electrolyte body are balanced. The fine particles are associated while the average particle diameter and the particle size distribution are controlled. At the same time, the fine particles are fused by stirring under heating, to control the shape of the particles, thereby producing the toner particles.

The resin fine particles may have a multilayer structure of two or more layers made from binder resins having different compositions. When resin fine particles having a layer structure of two layers is produced, a process in which a polymerization initiator and a polymerizable monomer are added to a dispersion liquid of core fine resin particles prepared by an emulsion polymerization treatment (first-stage polymerization) according to a method known per se in the art, and this system is subjected to a polymerization treatment (second-stage polymerization) may be adopted.

When the toner particles have a core-shell structure in which a core resin constituting core particles is a styrene-acrylic copolymer resin and a shell layer contains the polyfunctional acrylate-modified polyester resin according to the present invention, the toner particles can be produced as follows.

An aqueous dispersion liquid of fine particles containing a styrene-acrylic copolymer resin and a parting agent and an aqueous dispersion liquid of fine particles of polyfunctional acrylate-modified polyester resin are each prepared by the emulsion polymerization process. In an aqueous medium, fine particles containing a styrene-acrylic copolymer resin and fine colorant particles are then associated, aggregated and fused to produce core particles. Fine particles of the polyfunctional acrylate-modified polyester resin to form a shell layer are added to the dispersion liquid of the core particles. As a result, the fine particles of the polyfunctional acrylate-modified polyester resin are aggregated and fused on the surface of the core particles. Thus, a shell layer coating the surface of the core particles is formed, thereby producing the toner particles.

As a polymerizable monomer for production of a styrene-acrylic copolymer resin by the emulsion polymerization process, a styrene-based monomer such as styrene, methylstyrene, methoxystyrene, butylstyrene, phenylstyrene and chlorostyrene; a (meth)acrylate-based monomer such as methyl (meth)acrylate, ethyl (meth)acrylate, butyl (meth) acrylate and ethylhexyl (meth)acrylate; or a carboxylic acid-based monomer such as acrylic acid, methacrylic acid and fumeric acid may be used. These monomers may be used either singly or in any combination thereof.

External Additive:

The toner particles can be used as they are to form the toner of the present invention. However, in order to improve flowability, charge property and cleaning property, an external additive such as a flowability improver and a cleaning aid, which are so-called post treatment agents, may be added to the toner particles to form the toner of the present invention.

As examples of the post treatment agents, may be mentioned fine inorganic oxide particles such as fine silica particles, fine alumina particles and fine titanium oxide particles; fine inorganic stearic acid compound particles such as fins aluminum stearate particles and fine zinc stearate particles; and fine inorganic titanic acid compound particles such as fine strontium titanate particles and fins sine titanate particles. These post treatment agents may be used either singly or in any combination thereof.

It is preferable that the fine inorganic particles have been subjected to a surface treatment with a silane coupling agent, a titanium coupling agent, a higher fatty acid or a silicone oil to improve the heat-resistant storage stability and the environmental staibility.

The total content of these various external additives is 0.05 to 5 parts by mass, preferably 0.1 to 3 parts by mass per 100 parts by mass of the toner. Various external additives may be used in combination.

Developer:

The toner of the present invention may be used as a magnetic or non-magnetic one-component developer, but may be mixed with a carrier to be used as a two-component developer. When the toner of the present invention is need as the two-component developer, magnetic particles made of a conventionally known material including a metal such as iron, a magnetic material such as ferrite and magnetite and an alloy of the metal or the magnetic material with a metal such as aluminum or lead may be used as the carrier. In particular, ferrite particles are preferred. In addition, a coated carrier obtained by coating the surface of magnetic particles with a coating aging such as a resin or a binder-type carrier obtained by dispersing magnetic fine powder in a binder resin can be used as the carrier.

No particular limitation is imposed on a coating resin forming the coated carrier, and as examples thereof, may be mentioned an olefin resin, a styrene resin, a styrene-acrylic copolymer resin, a silicone resin, an ester resin and a fluororesin. No particular limitation is imposed on a resin constituting a resin, dispersion-type carrier, and a publicly known resin can be used. For example, a styrene-acrylic copolymer resin, a polyester resin, a fluororesin or a phenol resin can be used.

The volume-based median diameter of the carrier is preferably 15 to 100 μm, more preferably 25 to 80 μm. The volume-based median diameter of the carrier can he measured typically using a laser diffraction-type particle size distribution measuring device "HELOS" (manufactured by Sympatec GmbH) equipped with a wet dispersing device.

As examples of a preferable carrier, may be mentioned a coated carrier using a silicone resin, a copolymer resin (graft copolymer resin) of organopolysiloxane and a vinyl monomer or a polyester resin as the coating resin from the viewpoint of spent resistance. In particular, as examples of the preferable carrier, may be mentioned a coated carrier coated with a resin obtained by reaction of a copolymer resin (graft copolymer resin) of organopolysiloxane and a vinyl monomer with isocyanate as the coating resin from the viewpoint of durability, environment resistant stability and spent resistance.

According to the toner of the present invention, high varnish application property and high adhesion of a varnish layer to a fixed image can be achieved even when the varnish layer is formed on the fixed image. This is because the toner particles contain the polyfunctional acrylate-modified polyester resin obtained by modification with a polyfunctional acrylate compound.

Image Formation Process:

As the image formation process of the present invention, an image formation process of an electrophotographic system, is used. Specifically, the image formation process comprises: a developing step of developing an electrostatic latent image formed on an image carrier with the toner of the present invention; a transferring step of transferring a developed toner image to an image support; and a varnish layer forming step of applying a photocurable varnish (hereinafter may also be referred to as "varnish" simply) to the toner image transferred onto the image support and exposing the varnish to light to form a varnish layer. In general, in the image formation process, a fixing step of heat-fixing the toner image transferred to the image support is carried out after the transferring step, and the varnish layer forming step is then carried out. In this case, the varnish is applied to the fixed image.

The developing step, the transferring step and the fixing step can be carried out by a process which is generally used.

Image Support:

As examples of the image support used in the image formation process of the present invention, may be mentioned a plain paper including a thin paper and a thick paper, a high-quality paper, a coated printer paper including an art paper and a coated paper, commercially available Japanese paper and postcard paper, a plastic film for OHP and cloths, but it is not limited to these.

Varnish Layer Forming Step:

The varnish layer forming step can be carried out immediately or soon after formation of the fixed image by the transferring step or the fixing step. Specifically, the photocurable varnish is applied to a face having the fixed image of the image support, and exposed to light, to cure the photocurable varnish, forming the varnish layer.

The varnish layer can be formed so that the whole face having the fixed image formed on the image support, the whole or part of the fixed image on the image support or part of the image support is coated.

Photocurable Varnish:

The photocurable varnish does not contain a solvent which affects the human body, and is capable of moving a next step before completion of drying after curing, so that high productivity can be achieved. In particular, a photocurable varnish containing a radically polymerizable compound is preferably used since the photocurable varnish is stably cured without change of degree of cure due to change of humidity.

It is preferable that the photocurable varnish contains a polyfunctional radically polymerizable oligomer, a polyfunctional radically polymerizable monomer, a photopolymerization initiator, a surfactant and an additive as basic components.

The polyfunctional radically polymerizable monomer is a radically polymerizable monomer having two or more acrylate groups. The polyfunctional radically polymerizable oligomer is a radically polymerizable oligomer having two or more acrylate groups.

As the polyfunctional radically polymerizable oligomer constituting the photocurable varnish, one or more kinds appropriately selected from diacrylate, triacrylate, tetraacrylate, dimethacrylate, trimethacrylate and tetramethacrylate can be used.

The photocurable varnish may contain a monofunctional radically polymerizable monomer. The monofunctional radically polymerizable monomer can be appropriately selected from acrylic acid, acrylate and methacrylate.

The photopolymerization initiator can be appropriately selected from anthraquinone, benzophenone, 2-ethylanthraquinone, acetophenone, O-acyloxim, alkylphenone, acylphosphineoxide and titanocene.

As the surfactant constituting the photocurable varnish, an anionic surfactant, a nonionic surfactant, a silicone surfactant or a fluoro surfactant can be used.

As the anionic surfactant, sulfosuccinate, disulfonate, phosphate, sulfate, sulfonate or a mixture thereof can be used.

As the nonionic surfactant, polyvinyl alcohol, polyacrylic acid, isopropyl alcohol, acetylenic diol, ethoxylated octylphenol, ethoxylated branched secondary alcohol, perfluorobutane sulfonate or alkoxylated alcohol can be used.

As the silicone surfactant, polyether-modified polydimethyl siloxane can be used.

As the fluoro surfactant, ethoxylated nonylphenol can be used.

When such a surfactant is used, an interface between a toner and a varnish is provided with absorptive property or the surface tension of the varnish decreases and so the wettability of the varnish is improved.

Process of Applying Varnish:

The varnish can be applied with a liquid applying device including a roll center, a flexo coater, a rod coater, a blade, a wire bar, an air knife, a curtain coater, a slide coater, a doctor knife, a screen coater, a gravure coater (e.g., offset gravure coater), a slot coater, an extruding coater and an inkjet coater. As such a device, a publicly known system such as forward and reverse roll coating, offset gravure coating, curtain coating, lithography coating, screen coating, gravure coating and inkjet coating can be used.

As a light source of emitting light for curing of the varnish, may be mentioned a low pressure mercury lamp, a medium pressure mercury lamp, a high pressure mercury lamp, a ultra-high pressure mercury lamp, a xenon lamp, a carbon arc lamp, a metal halide lamp, a fluorescent lamp, a tungsten lamp and an LED.

According to the image formation process of the present invention, high varnish application property and high adhesion of a varnish layer to a fixed image can be achieved even when the varnish layer is formed on the fixed image. This is because the toner including the toner particles containing a polyfunctioned acrylate-modified polyester resin obtained by modification with a polyfunctional acrylate compound is used.

The embodiments of the present invention have been specifically described above. However, the embodiments of the present invention are not limited to the above-described examples, and various modifications may be made.

For example, a polyfunctional acrylate-modified polyester resin is not limited to a polyfunctional acrylate-modified polyester resin in which, a site derived from a polyfunctional acrylate compound and an unmodified polyester resin are bonded through an ester bond, and may be a polyfunctional acrylate-modified polyester resin in which a site derived from a polyfunctional acrylate compound and an unmodified polyester resin are bonded through an urea bond or an urethane bond.

EXAMPLES

Hereinafter, Examples of the present invention will be specifically described, but the present invention is not limited to these Examples.

Example 1

Production Example 1 of Toner (1) Preparation of Dispersion Liquid of Fine Polyfunctional Acrylate-Modified Polyester Resin Particles (a) Synthesis of Polyfunctional Acrylate-Modified Polyester Resin A reactor equipped with a stirrer, a nitrogen inlet tube, a thermo sensor and a rectification column was charged with 4.2 parts by mass of fumaric acid, 78 parts by mass of terephthalic acid and 3.8 parts by mass of trimellitic acid as polyvalent carboxylic acid components, 152 parts by mass of 2-mol adduct of 2,2-bis (4-hydroxyphenyl) propane propylene oxide and 48 parts by mass of 2-mol adduct of 2,2-bis (4-hydroxyphenyl) propane ethylene oxide as polyhydric alcohol components. The temperature in the reactor was increased to 190° C. over 1 hour. After it was confirmed that the mixture in the reactor was uniformly stirred, Ti(OBu)4 was added as a catalyst so that the content thereof per the whole amount of the polyvalent carboxylic acid components was 0.006% by mass. A dehydration-condensation reaction was carried out by increasing the temperature in the reactor from 190° to 240° C. over 6 hours and further keeping the temperature at 240° C. over 6 hours while produced water was removed. Thus, a polymerization reaction was carried out to obtain a polyester resin [a].

To the reactor, 11 parts by mass of 2-hydroxy-3-acryloyloxypropyl methacrylate as a polyfunctional acrylate compound was added. A dehydration-condensation reaction was continuously carried out with the temperature kept at 240° C. over 3 hours. Thus, a polymerization reaction was carried out to obtain a polyfunctional acrylate-modified polyester resin [A].

The obtained polyfunctional acrylate-modified polyester resin [A] had a number average molecular weight (Mn) of 3,100 and a glass transition point (Tg) of 63° C.

(b) Production of Fine Polyfunctional Acrylate-Modified Polyester Resin Particles Methyl ethyl ketone and isopropyl alcohol were placed in a reactor equipped with an anchor blade providing a stirring power. The above-described polyfunctional acrylate-modified polyester resin [A] was crushed with a hammer mill, gradually added to the reactor, stirred and completely dissolved, to obtain a polyfunctional acrylate-modified polyester resin solution as an oil phase. Subsequently, a few drops of dilute aqueous ammonia solution was added dropwise to the oil phase under stirring, and ion-exchanged water was then added dropwise to cause phase inversion emulsification. After that, the solvent was removed with an evaporator under reduced pressure to produce fine polyfunctional acrylate-modified polyester resin particles. Ion-exchanged water was further added to adjust the solid content to 20% by mass. Thus, a dispersion liquid of the fine polyfunctional acrylate-modified polyester resin particles [A]was obtained.

The volume-based median diameter of the resin fine particles in the dispersion liquid of the fine polyfunctional acrylate-modified polyester resin particles [A] was measured with an electrophoretic light scattering photometer "ELS-800" (manufactured by Otsuka Electronics Co., Ltd.) to be 185 nm.

(2) Preparation of Dispersion Liquid of Fine Styrene-Acrylic Copolymer Resin Particles (a) Production of Resin Fine Particles 1H In a reactor equipped with a stirrer, a thermo sensor, a condenser and a nitrogen inlet tube, 7.08 parts by mass of sodium dodecylsulfate as an anionic surfactant was dissolved in 3,010 parts by mass of ion-exchanged water to prepare a surfactant solution. While the surfactant solution was stirred at a stirring rate of 230 rpm under a nitrogen stream, the temperature in the reactor was increased to 80° C.

To the surfactant solution, a polymerization initiator solution prepared by dissolving 9.2 parts by mass of potassium persulfate (KPS) as a polymerization initiator in 200 parts by mass of ion-exchanged water was added. Subsequently, the temperature in the reactor was adjusted to 75° C. A liquid mixture [1] obtained by mixing 69.4 parts by mass of styrene, 28.3 parts by mass of n-butyl acrylate and 2.3 parts by mass of methacrylic acid was added dropwise to the reactor over 1 hour. The mixture was further stirred at 75° C. for 2 hours to cause polymerization. Thus, a dispersion liquid of resin fine particles [1H] in which resin fine particles [1H] were dispersed was prepared, (b) Production of RResin Fine Particles 1HM In a flask equipped with a stirrer, 97.1 parts by mass of styrene, 39.7 parts by mass of n-butyl acrylate, 3.22 parts by mass of methacrylic acid and 5.6 parts by mass of n-octyl-3-mercaptopropionic acid ester were placed, and further 98.0 parts by mass of pentacrythritol tetrabehenate was added thereto. The mixture was heated to 90° C. to prepare a liquid mixture [2] containing the above-described compounds.

In a reactor equipped with a stirrer, a thermo sensor, a condenser and a nitrogen inlet tube, 1.6 parts by mass of sodium dodecylsulfate was dissolved in 2,700 parts by mass of ion-exchanged water to prepare a surfactant solution. The surfactant solution was heated to 98° C. After that, the resin above fine particle dispersion liquid [1H] was added in an amount of 28 parts by mass in terms of solid content to the surfactant solution, and the liquid mixture [2] was added. The mixture was mixed and dispersed for 2 hours with a mechanical dispersing device having a circulation path "CLEARMIX" (manufactured by M Technique Co., Ltd.) to prepare a dispersion liquid (emulsion liquid).

To the emulsion liquid, an initiator solution prepared by dissolving 5.1 parts by mass pf potassium persulfate (KPS) to 240 parts by mass of ion-exchanged water and 750 parts by mass of ion-exchanged water were added. Polymerization was carried out under stirring at 98° C. for 2 hours. As a result, a dispersion liquid of resin fine particles [1HM] having a composite structure in which the surface of the resin fine particles [1H] was coated with a resin layer was prepared.

(c) Production of Resin Fine Particles 1HML

To the above dispersion liquid of the resin fine particle [1HM], an initiator solution prepared by dissolving 7.4 parts by mass of potassium persulfate (KPS) in 200 parts by mass of ion-exchanged water was added, and the temperature was adjusted to 80° C. To the mixture, a liquid mixture [3] prepared, by mixing 277 parts by mass of styrene, 113 parts by mass of n-butyl acrylate, 9.21 parts by mass of methacrylic acid and 10.4 parts by mass of n-octyl-3-mercaptopropionic acid ester was added dropwise over 1 hour. Polymerization was carried out under heating and stirring at 80° C. over 2 hours. After that, the reaction system, was cooled to 28° C. to prepare a dispersion liquid of fine styrene-acrylic copolymer resin particles [1] in which the resin fine particles [1HML] having a composite structure in which the surface of the resin fine particles [1HM] was coated with a resin layer were dispersed.

(3) Formation of Toner Base Particles (a) Formation of Core Particles

In a reactor equipped with a stirrer, a thermo sensor, a condenser and a nitrogen inlet tube, 450 parts by mass (in terms of solid content) of the dispersion liquid of the fine styrene-acrylic copolymer resin particles [1], 1,100 parts by mass of ion-exchanged water and 100 parts by mass (in terms of solid content) of carbon black dispersion liquid were placed, and the liquid temperature was adjusted to 30° C. A 5 mol/L aqueous sodium hydroxide solution was added to the mixture to adjust the pH to 10.0.

An aqueous solution prepared by dissolving 60 parts by mass of magnesium chloride hexahydrate in 60 parts by mass of ion-exchanged water was added over 10 minutes under stirring, and the mixture was allowed to stand for 3 minutes. The temperature in this system was increased to 90° C. over 60 minutes, so that the resin fine particles were associated and grown with the temperature kept at 90° C. The particle diameter of the associated particles was measured with "Multisizer 3" (manufactured by Coulter Beckmann, Inc. ). When the volume-based median diameter reached 5.5 μm, an aqueous solution prepared by dissolving 40.2 parts by mass of sodium chloride in 1,000 parts by mass of ion-exchanged water was added to this reaction system to stop the growth of the particles. Thus, core particles [1] were formed.

(b) Formation of Shell Layer

Subsequently, the temperature of 550 parts by mass (in terms of solid content) of dispersion liquid of the core particles [1]was adjusted to 90° C., To the dispersion liquid, 50 parts by mass (in terms of solid content) of the dispersion liquid of the fine polyfunctional acrylate-modified polyester resin particles [A]was added. To the mixture, an aqueous solution prepared by dissolving 60 parts by mass of magnesium chloride hexahydrate in 60 parts by mass of ion-exchanged water was added ever 10 minutes under stirring. This mixture was continuously stirred for 1 hour to fuse the fine polyfunctional acrylate-modified polyester resin particles [A] to the surface of the core particles [1]. After that, an aqueous solution prepared by dissolving 40.2 parts by mass of sodium chloride in 1,000 parts by mass of ion-exchanged water was added. The mixture was stirred under heating at 95° C. for 20 minutes to complete an aging treatment. After the formation of a shell layer, the resultant was cooled to 30° C., and the solid content was separated by filtration, repeatedly washed with ion exchanged water at 35° C., and dried by hot air at 40° C., to obtain toner base particles [1] in which the surface of the core particles [1] was coated with the shell layer.

(4) Addition of External Additive

To 100 parts by mass of the obtained toner base particles [1], 0.6 parts by mass of hydrophobic silica (number average primary particle diameter: 12 nm, degree of hydrophobization: 68) and 1. 0 part by mass of hydrophobic titanium oxide (number average primary particle diameter: 20 μm, degree of hydrophobization: 63) were added, and the mixture was mixed with a Henschel mixer (manufactured by Mitsui Miike Chemical Engineering Machinery, Co., Ltd.) at a rotor blade peripheral rate of 35 mm/sec and a temperature of 32° C. for 20 minutes. In an external additive treatment, coarse particles were removed using a sieve having a sieve opening of 45 μm. As a result, a toner [1] was produced.

Example 2

Production Example 2 of Toner

A toner [2] was produced in the same manner as in Example 1 except that 138 parts by mass (in terms of solid content) of the dispersion liquid of the fine polyfunctional acrylate-modified polyester resin particles [A] was used instead of 50 parts by mass (in terms of solid content) of the dispersion liquid of the fine polyfunctional acrylate-modified polyester resin particles [A] in (3) (b) Formation of shell layer in Example 1; production example 1 of toner.

Example 3

Production Example 3 of Toner

A toner [3] was produced, in the same manner as in Example 1 except that 15 parts by mass of pentaerythritol triacrylate was used as the polyfunctional acrylate compound instead of 11 parts by mass of 2-hydroxy-3-acryloyloxypropyl methacrylate in (1) (a) Synthesis of polyfunctional acrylate-modified polyester resin in Example 1: production example 1 of toner.

Example 4

Production Example 4 of Toner

A toner [4] was produced in the same manner as in Example 1 except that 11 parts by mass of glycerin dimethacrylate was used as the polyfunctional acrylate compound instead of 11 parts by mass of 2-hydroxy-3-acryloyloxypropyl methacrylate in (1) (a) Synthesis of polyfunctional acrylate-modified polyester resin in Example 1: production example 1 of toner.

Example 5

Production Example 5 of Toner

A toner [5] was produced in the same manner as in Example 1 except that 11 parts by mass of 2-hydroxy-3-acryloyloxypropyl methacrylate and 12 parts by mass of 2-methacrylcyloxyethyl succinate were used as the polyfunctional acrylate compound instead of 11 parts by mass of 2-hydroxy-3-acryloyloxypropyl methacrylate in (1) (a) Synthesis of polyfunctional acrylate-modified polyester resin in Example 1: production example 1 of toner.

Example 6

Production Example 6 of Toner

A toner [6] was produced in the same manner as in Example 1 except that 15 parts by mass of pentaerythritol triacrylate and 12 parts by mass of 2-methacryloyloxyethyl succinate were used as the polyfunctional acrylate compound instead of 11 parts by mass of 2-hydroxy-3-acryloyloxypropyl methacrylate in (1) (a) Synthesis of polyfunctional acrylate-modified polyester resin in Example 1: production example 1 of toner.

Example 7

Production Example 7 of Toner

A toner [7] was produced in the same manner as in Example 1 except that 11 parts by mass of glycerin dimethacrylate and 12 parts by mass of 2-methacryloyloxyethyl succinate were used as the polyfunctional acrylate compound instead of 11 parts by mass of 2-hydroxy-3-acryloyloxypropyl methacrylate in (1) (a) Synthesis of polyfunctional acrylate-modified polyester resin in Example 1 production example 1 of toner.

Example 8

Production Example 8 of Toner (1) Formation of Toner Base Particles

In a reactor equipped with a stirrer, a thermo sensor, a condenser and a nitrogen inlet tube, 450 parts by mass (in terms of solid content) of the dispersion liquid of the fine polyfunctional acrylate-modified polyester resin particles [A], 1,100 parts by mass of ion-exchanged water, 100 parts by mass (in terms of solid, content) of carbon black dispersion liquid, 16.0 parts by mass of dispersion liquid of n-octyl-3-mercaptopropionic acid ester and 98.0 parts by mass (in terms of solid content) of dispersion liquid of pentaerythritol tetrabehenate were placed, and the liquid temperature was adjusted to 30° C. An aqueous solution prepared by dissolving 60 parts by mass of magnesium chloride hexahydrate in 60 parts by mass of ion-exchanged water was added over 10 minutes under stirring, and the mixture was allowed to stand, for 3 minutes. The temperature in this system was increased to 90° C. over 60 minutes, so that the resin fine particles were associated and grown, with the temperature kept at 90° C. The particle diameter of the associated particles was measured with "Multisizer 3" (manufactured by Coulter Beckmann, Inc.). When the volume-based median diameter reached 5.5 μm, an aqueous solution prepared by dissolving 40.2 parts by mass of sodium chloride in 1,000 parts by mass of ion-exchanged water was added to this reaction system to stop the growth of the particles. Thus, toner base particles [8] were obtained.

(2) Addition of External Additive

To 100 parts by mass of the obtained toner base particles [8], 0.6 parts by mass of hydrophobic silica (number average primary particle diameter: 12 nm, degree of hydrophobization: 68) and 1.0 part by mass of hydrophobic titanium oxide (number average primary particle diameter: 20 nm, degree of hydrophobization; 63) were added, and the mixture was mixed with a Henschel mixer (manufactured by Mitsui Miike Chemical Engineering Machinery, Co., Ltd.) at a rotor blade peripheral rate of 35 mm/sec and a temperature of 32° C. for 20 minutes. In an external additive treatment, coarse particles were removed using a sieve having a sieve opening of 45 μm. As a result, a toner [8] was produced.

Comparative Example 1

Production Example 9 of Toner (1) Preparation of Dispersion Liquid of Fine Polyester Resin Particles (a) Synthesis of Polyester Resin A reactor equipped with a stirrer, a nitrogen inlet tube, a thermo sensor and a rectification column was charged with 4.2 parts by mass of fumaric acid, 78 parts by mass of terephthalic acid and 3.8 parts by mass of trimellitic acid as polyvalent carboxylic acid components, 152 parts by mass of 2-mol adduct of 2,2-bis(4-hydroxyphenyl) propane propylene oxide and 48 parts by mass of 2-mol adduct of 2,2-bis (4-hydroxyphenyl) propane ethylene oxide as polyhydric alcohol components. The temperature in the reactor was increased to 190° C. over 1 hour. After it was confirmed that the mixture in the reactor was uniformly stirred, $Ti(OBu)_4$ was added as a catalyst so that the content per the whole amount of the polyvalent carboxylic acid components was 0.006% by mass. A dehydration-condensation reaction was carried out by increasing the temperature in the reactor from 190° C. to 240° C. over 6 hours and further keeping the temperature at 240° C. over 6 hours while produced water was removed. Thus, a polymerization reaction was carried out to obtain a polyester resin [b].

The obtained polyester resin [b] had a number average molecular weight (Mn) of 3,100 and a glass transition point (Tg) of 63° C.

(b) Production of Fine Polyester Resin Particles

Methyl ethyl ketone and isopropyl alcohol were placed in a reactor equipped with an anchor blade providing a stirring power. The polyester resin [b] was crushed with a hammer mill, gradually added to the reactor, stirred and completely dissolved, to obtain a polyester resin solution as an oil phase. Subsequently, a few drops of dilute aqueous ammonia solution was added dropwise to the oil phase under stirring, and this oil phase was then added dropwise to ion-exchanged water to cause phase inversion emulsification. After that, the solvent was removed with an evaporator under reduced pressure to produce fine polyester resin particles. Ion-exchanged water was further added to adjust the solid content to 20% by mass. Thus, a dispersion liquid of fine polyester resin particles [B] was obtained.

The volume-based median diameter of the resin fine particles in the resultant dispersion liquid of fine polyester resin particles [B] was measured to be 190 nm.

(2) Formation of Toner Base Particles (a) Formation of Core Particles

In a reactor equipped with a stirrer, a thermo sensor, a condenser and a nitrogen inlet tube, 450 parts by mass (in terms of solid content) of the dispersion liquid of the fine polyester resin particles [B], 1,100 parts by mass of ion-exchanged water, 100 parts by mass (in terms of solid content) of carbon black dispersion liquid, 16.0 parts by mass in terms of solid content) of dispersion liquid of n-octyl-3-mercaptopropionic acid ester and 98.0 parts by mass (in terms of solid content) of dispersion liquid of pentaerythritol tetrabehenate were placed, and the liquid temperature was adjusted to 30° C. An aqueous solution prepared by dissolving 60 parts by mass of magnesium chloride hexahydrate in 50 parts by mass of ion-exchanged water was added over 10 minutes under stirring, and the mixture was allowed to stand, for 3 minutes. The temperature in this system was increased to 90° C. over 60 minutes, so that the resin fine particles were associated and grown with the temperature kept at 90° C. The particle diameter of the associated particles was measured with "Multisiser 3" (manufactured by Coulter Beckmann, Inc.). When the volume-based median diameter reached. 5.5 gap an aqueous solution prepared by dissolving 40.2 parts by mass of sodium chloride in 1,000 parts by mass of ion-exchanged water was added to this reaction system to stop the growth of the particles. Thus, core particles [9] were obtained.

(b) Formation of Shell Layer

Subsequently, the temperature of 550 parts by mass (in terms of solid content) of the dispersion liquid of the core particles [9] was adjusted to 90° C. To the dispersion liquid, 50 parts by mass (in terms of solid content) of the dispersion liquid of the fine polyester resin particles [B] was added. An aqueous solution prepared by dissolving 60 parts by mass of magnesium chloride hexahydrate in 60 parts by mass of ion-exchanged water was added over 10 minutes under stirring. This mixture was continuously stirred for 1 hour to fuse the fine polyester resin particles [B] to the surface of the core particles [9]. After that, an aqueous solution prepared by dissolving 40.2 parts by mass of sodium chloride in in 1,000 parts by mass of ion-exchanged water was added. The mixture was stirred under heating at 95° C. for 20 minutes to complete an aging treatment. After the formation of a shell layer, the resultant was cooled to 30° C., and the solid content was separated by filtration, repeatedly washed with ion-exchanged water at 35° C., and dried by hot air at 40° C., to obtain toner base particles [9] in which the surface of the core particles [9] was coated with the shell layer.

(3) Addition of External Additive

To 100 parts by mass of the obtained toner base particles [9], 0.5 parts by mass of hydrophobic silica (number average primary particle diameter; 12 nm, degree of hydrophobization: 68) and 1.0 part by mass of hydrophobic titanium oxide (number average primary particle diameter: 20 nm, degree of hydrophobization: 63) were added, and the mixture was mixed with a Henschel mixer (manufactured by Mitsui Miike Chemical Engineering Machinery, Co., Ltd.) at a rotor blade peripheral rate of 35 mm/sec. and a temperature of 32° C. for 20 minutes. In an external additive treatment, coarse particles were removed, using a sieve having a sieve opening of 45 μm. As a result, a toner [9] was produced.

Comparative Example 2

Production Example 10 of Toner (1) Preparation of Dispersion Liquid of Fine Styrene-Acrylic Copolymer Resin Particles In a reactor equipped with a stirrer, a thermo sensor, a condenser and a nitrogen inlet tube, 2.0 parts by mass of sodium dodecylsulfate as an anionic surfactant was dissolved in 3,000 parts by mass of ion-exchanged water to prepare a surfactant solution. While the surfactant solution was stirred at a stirring rate of 230 rpm under a nitrogen stream, the temperature in the reactor was increased to 80° C.

Subsequently, 544 parts by mass of styrene, 160 parts by mass of n-butyl acrylate, 96 parts by mass of methacrylic acid and 20 parts by mass of n-octylmercaptan were mixed to prepare a liquid mixture [a4].

To the surfactant solution, an initiator solution prepared by dissolving 10 parts by mass of potassium, persulfate (KPS) in 200 parts by mass of ion-exchanged water was added. To the mixture, the liquid mixture [a4] was added dropwise over 3 hours. Polymerization was carried out under heating and stirring at 80° C. for 1 hour, to prepare a dispersion liquid of fine styrene-acrylic copolymer resin particles [2].

(2) Formation of Toner Base Particles and Addition of External Additive

A toner [10] was produced in the same manner as in Example 1 except that 50 parts by mass (in terms of solid content) of the dispersion liquid of the fine styrene-acrylic copolymer resin particles [2] was used instead of 50 parts by mass (in terms of solid content) of the dispersion liquid of the fine polyfunctional acrylate-modified polyester resin particles [A] in (3) (b) Formation of shell layer in Example 1; production example 1 of toner.

Comparative Example 3

Production Example 11 of Toner

A toner [11] was produced in the same manner as in Example 1 except that 9 parts by mass (as content of 8.3% by mass) of dipropylene glycol acrylate was used as the polyfunctional acrylate compound instead of 11 parts by mass of 2-hydroxy-3-acryloyloxypropyl methacrylate in (1) (a) Synthesis of polyfunctional acrylate-modified polyester resin in Example 1: production example 1 of toner.

Production Examples 1 to 11 of Developer

A ferrite carrier coated with a silicone resin and having a volume average particle diameter of 60 μm was mixed in each of the toners [1] to [11] so that the toner concentration was 6% by mass, to prepare each of developers [1] to [11].

Formation of Fixed Image for Evaluation

Each fixed image with an amount of toner adhered of 4 g/m$^2$ was formed on "OK Top Coat 128 g/m$^2$" (available from Oji Paper Co., Ltd.) using a multifunction color printer "bizhubC6500" (manufactured by Konica Minolta Business Solutions Japan Co., Ltd.) to which each of the developers [1] to [11] was installed, at a fixing linear velocity of 310 mm/min (about 65 sheets/min).

A photoradically polymerizable varnish "UV VECTA Coating Varnish PC-3KW2" (available from T&K TOKA Corporation) was applied using a wire bar in a thickness of 3 μm to an image support having each fixed image formed thereon, and exposed to ultraviolet rays using a UV irradiation device having a high-pressure mercury lamp as a light source so that the integrated amount of light on the fixed image face was 80 to 100 mJ/cm$^2$ to be cured to form a varnish layer. Thus, print samples [1] to [11] were obtained.

The application property and adhesion of the print samples [1] to [11] were evaluated. The results are shown in Table 1. When the evaluation of varnish application property of a print sample is "C, " the print sample is not subjected to the evaluation of adhesion.

Evaluation of Varnish Application Property:

The varnish layer on each of the print samples was visually observed, and the varnish application property was evaluated in accordance with the following evaluation criteria.

Evaluation Criteria:

A: No varnish repellent was observed (acceptable).

B: Varnish repellent was partially observed (acceptable).

C: Varnish repellent was observed on the entire face (unacceptable).

Evaluation of Adhesion:

The adhesion of the varnish layer to the fixed image was evaluated in accordance with the following procedure:

1. A cutter blade is snapped off to renew the blade.
2. Using a cutting guide, a specimen is scratched using the cutter blade with an inclination angle of 60 degrees to form a grid with 3 mm by 3 mm side.
3. To the intersection of cutting traces in the grid form, a piece of cellophane tape is adhered while the tape is rubbed with a ball of a finger a few times to press it. Then, the tip of the tape is picked to be peeled with an angle of 60 degrees for 0.5 to 1.0 second.
4. Among nine portions, the number of remaining portions is counted for evaluation.

TABLE 1

| | | POLYFUNCTIONAL ACRYLATE-MODIFIED POLYESTER RESIN | | | STRUCTURE | | EVALUATION RESULT VARNISH | |
|---|---|---|---|---|---|---|---|---|
| | TONER No. | MAIN CHAIN | POLYFUNCTIONAL ACRYLATE COMPOUND | CONTENT (% BY MASS) | OF TONER PARTICLES | CORE RESIN | APPLICATION PROPERTY | ADHESION |
| EXAMPLE 1 | 1 | PEs RESIN | 2-HYDROXY-3-ACRYLOYLOXYPROPYL METHACRYLATE | 8.3 | CORE-SHELL | St-Ac RESIN | A | 9 |
| EXAMPLE 2 | 2 | PEs RESIN | 2-HYDROXY-3-ACRYLOYLOXYPROPYL METHACRYLATE | 20 | CORE-SHELL | St-Ac RESIN | A | 9 |
| EXAMPLE 3 | 3 | PEs RESIN | PENTAERYTHRITOL TRIACRYLATE | 8.3 | CORE-SHELL | St-Ac RESIN | A | 9 |
| EXAMPLE 4 | 4 | PEs RESIN | GLYCERIN DIMETHACRYLATE | 8.3 | CORE-SHELL | St-Ac RESIN | A | 9 |
| EXAMPLE 5 | 5 | PEs RESIN | 2-HYDROXY-3-ACRYLOYLOXYPROPYL METHACRYLATE | 8.3 | CORE-SHELL | St-Ac RESIN | A | 9 |
| EXAMPLE 6 | 6 | PEs RESIN | PENTAERYTHRITOL TRIACRYLATE | 8.3 | CORE-SHELL | St-Ac RESIN | A | 9 |
| EXAMPLE 7 | 7 | PEs RESIN | GLYCERIN DIMETHACRYLATE | 8.3 | CORE-SHELL | St-Ac RESIN | A | 9 |
| EXAMPLE 8 | 8 | PEs RESIN | 2-HYDROXY-3-ACRYLOYLOXYPROPYL METHACRYLATE | 100 | SINGLE LAYER | — | A | 9 |

TABLE 1-continued

| | | POLYFUNCTIONAL ACRYLATE-MODIFIED POLYESTER RESIN | | | STRUCTURE | | EVALUATION RESULT VARNISH | |
|---|---|---|---|---|---|---|---|---|
| | TONER No. | MAIN CHAIN | POLYFUNCTIONAL ACRYLATE COMPOUND | CONTENT (% BY MASS) | OF TONER PARTICLES | CORE RESIN | APPLICATION PROPERTY | ADHESION |
| COMPARATIVE EXAMPLE 1 | 9 | PEs RESIN | — | 0 | CORE-SHELL | PEs RESIN | A | 6 |
| COMPARATIVE EXAMPLE 2 | 10 | St-Ac RESIN | — | 0 | CORE-SHELL | St-Ac RESIN | C | — |
| COMPARATIVE EXAMPLE 3 | 11 | PEs RESIN | DIPROPYLENE GLYCOL ACRYLATE | 8.3 | CORE-SHELL | St-Ac RESIN | A | 8 |

The invention claimed is:

1. A toner for electrostatic image development, comprising toner particles containing at least a binder resin, a colorant and a parting agent, wherein the binder resin contains a polyfunctional acrylate-modified polyester resin obtained by modification with a polyfunctional acrylate compound, the toner particles have a core-shell structure, in which a surface of a core particle is coated with a shell layer, the polyfunctional acrylate-modified polyester resin is contained in the shell layer, the polyfunctional acrylate-modified polyester resin has a moiety derived from the polyfunctional acrylate compound on a terminal thereof, and the polyfunctional acrylate compound is at least one kind selected from the group consisting of 2-hydroxy-3-acryloyloxypropyl methacrylate, pentaerythritol triacrylate, glycerin dimethacrylate and 3-acryloyloxy-2,2-bis (acryloyloxy(methyl))propionic acid.

2. The toner for electrostatic image development according to claim 1, wherein the polyfunctional acrylate-modified polyester resin has a glass transition point of 50 to 65° C.

3. The toner for electrostatic image development according to claim 1, wherein the polyfunctional acrylate-modified polyester resin has a weight average molecular weight (Mw) of 10,000 to 40,000.

4. The toner for electrostatic image development according to claim 1, wherein a content of the polyfunctional acrylate-modified polyester resin in the whole binder resin is 5 to 100% by mass.

5. The toner for electrostatic image development according to claim 1, wherein the core particles are formed from a styrene-acrylic copolymer resin.

6. The toner for electrostatic image development according to claim 5, wherein the toner particles are produced by, in an aqueous medium, associating, aggregating and fusing fine particles containing a styrene-acrylic copolymer resin and fine colorant particles to produce core particles; then adding fine particles of the polyfunctional acrylate-modified polyester resin to form a shell layer into a dispersion liquid of the core particles; and aggregating and fusing the fine particles of the polyfunctional acrylate-modified polyester resin on. the surface of the core particles, thereby forming the shell layer coating the surface of the core particles.

7. The toner for electrostatic image development according to claim 1, wherein the core particles are formed from a styrene-acrylic copolymer resin, and the styrene-acrylic copolymer resin has a weight average molecular weight (Mw) of a THF-soluble portion of 25,000 to 50,000 determined by gel permeation chromatography (GPC).

8. The toner for electrostatic image development according to claim 1, wherein the resin constituting the core particles has a glass transition point of 30 to 45° C.

9. The toner for electrostatic image development according to claim 1, wherein the parting agent is contained in the toner particles in a content of 3 to 15% by mass.

10. The toner for electrostatic image development according to claim 1, wherein the toner particles have an average particle diameter of 3 to 10 μm in terms of a volume-based median diameter.

11. The toner for electrostatic image development according to claim 1, wherein the toner particles are produced by an emulsion polymerization process.

12. A two-component developer comprising the toner for electrostatic image development according to claim 1, and a carrier.

13. An image formation process comprising:

a developing step of developing an electrostatic latent image formed on an image carrier with the toner for electrostatic image development according to claim 1;

a transferring step of transferring a developed toner image to an image support; and a step of applying a photocurable varnish to the toner image transferred to the image support or a fixed image obtained by heat-fixing the toner image and exposing the varnish to light to form a varnish layer.

14. The image formation, process according to claim 13, wherein the photocurable varnish contains a radically polymerizable compound.

15. The image formation process according to claim 13, wherein the photocurable varnish contains a polyfunctional radically polymerizable oligomer, a polyfunctional radically polymerizable monomer, a photopolymerization initiator and a surfactant.

* * * * *